US012759033B2

(12) United States Patent
He et al.

(10) Patent No.: US 12,759,033 B2
(45) Date of Patent: Oct. 13, 2026

(54) INTEGRAL FORMING METHOD FOR LARGE-SIZE THIN-WALLED RING SHELL

(71) Applicant: DALIAN UNIVERSITY OF TECHNOLOGY, Dalian (CN)

(72) Inventors: Zhubin He, Dalian (CN); Haihui Zhu, Dalian (CN); Jian Ning, Dalian (CN); Yanli Lin, Dalian (CN); Gaoning Tian, Dalian (CN); Xiangyue Sun, Dalian (CN); Yi Xu, Dalian (CN); Linwei Leng, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 267 days.

(21) Appl. No.: 18/769,033

(22) Filed: Jul. 10, 2024

(65) Prior Publication Data

US 2024/0359225 A1 Oct. 31, 2024

(30) Foreign Application Priority Data

Nov. 13, 2023 (CN) ..... 202311504101.8

(51) Int. Cl.
*B21C 23/14* (2006.01)

(52) U.S. Cl.
CPC ..... *B21C 23/14* (2013.01)

(58) Field of Classification Search
CPC ..... B21C 23/14; B21C 37/0807; B21C 37/15; B21C 37/155; B21C 37/30; B21C 37/065;
(Continued)

(56) References Cited

U.S. PATENT DOCUMENTS 11,141,770 B2 * 10/2021 Fortmeier ..... B21D 22/025
2006/0157539 A1 * 7/2006 DuBois ..... B21C 37/08 228/103

(Continued)

OTHER PUBLICATIONS

Huang, Xiaomin, et al. "Investigation of defect behavior during the stamping of a thin-walled semicircular shell with bending angle." Journal of Manufacturing Processes 87 (2023): 231-244 (Year: 2023).*

(Continued)

*Primary Examiner* — Christopher E. Everett
(74) *Attorney, Agent, or Firm* — MUNCY, GEISSLER, OLDS & LOWE, P.C.

(57) ABSTRACT

The present invention belongs to the technical field of metal forming manufacturing and discloses an integral forming method for a large-size thin-walled ring shell. The integral ring shell obtained by the forming method of the present invention has only one circumferential weld seam and one radial weld seam. If the two weld seams are located in an excisable process segment region, the target part without weld seams can be obtained after the process segment is cut off. The forming method of the present invention adopts a local thermal expansion forming method, plastic deformation occurs only in mold-constrained high temperature regions in a single local forming process, and a part with each region meeting the requirements can be obtained after several local thermal expansion forming processes. The forming method of the present invention can obtain two open cross-sectional ring shell components or multiple segmented ring shell components at one time.

3 Claims, 3 Drawing Sheets

(58) Field of Classification Search
CPC ..... B21D 5/10; B21D 7/06; B21D 9/15; B21D 53/92; B23P 15/00
See application file for complete search history.

(56) References Cited

U.S. PATENT DOCUMENTS

| | | | | |
|---|---|---|---|---|
| 2010/0096046 | A1* | 4/2010 | Krajewski | B21C 37/08 148/519 |
| 2017/0274434 | A1* | 9/2017 | Sato | B21D 5/015 |
| 2020/0114408 | A1* | 4/2020 | Fortmeier | B21D 5/015 |
| 2021/0362209 | A1* | 11/2021 | Yuan | B21D 9/18 |
| 2022/0371071 | A1* | 11/2022 | Freiberg | C22F 1/04 |

OTHER PUBLICATIONS

Kwon, Hyuck-Cheol, et al. "Surface wrinkle defect of carbon steel in the hot bar rolling process." Journal of Materials Processing Technology 209.9 (2009): 4476-4483 (Year: 2009).*

Zhang, Hongrui et al., Development and Challenge of Forming Manufacturing Technologies for Aerospace Large-Scale Thin-Wall Axisymmetric Curved-Surface Components, Journal of Mechanical Engineering, Oct. 2022, 20 pgs., vol. 58 No. 20.

Liu, Zhigang et al., Research on NC Processing Technology for a Thin-walled Shell Part, Machine Tool & Hydraulics, Jul. 2016, 3 pgs., vol. 44 No. 14.

* cited by examiner

INTEGRAL FORMING METHOD FOR LARGE-SIZE THIN-WALLED RING SHELL

TECHNICAL FIELD

The present invention belongs to the technical field of metal forming manufacturing, and particularly relates to an integral forming method for a large-size thin-walled ring shell.

BACKGROUND

A thin-walled ring shell refers to an annular shell part with the ratio of wall thickness to radial radius less than 1/20, and large-size thin-walled ring shell parts have important applications in aerospace, petrochemical industry, energy, water conservancy and other fields, mainly including aircraft engine intake lip, propellant tank for launch vehicle, petrochemical equipment and transportation pipeline. The large-size thin-walled ring shell parts are often in the working environment of complex loads of high temperature, high pressure, high strength and strong corrosion due to special application fields [Development and challenge of forming manufacturing technologies for aerospace large-scale thin-wall axisymmetric curved-surface components. Zhang Hongrui. 2022. Research on NC processing technology for a thin-walled shell part. Liu Zhigang. 2016]. In addition, the large-size thin-walled ring shell parts usually have structure characteristics of large curvature, large size and high depth-to-diameter ratio, which lead to higher requirements for shape accuracy, wall thickness uniformity and performance. Aerospace, petrochemical industry and other fields, driven by urgent needs of industrial technology development, have shown an integrated, lightweight, precise and low-damage development trend. Meanwhile, with global energy tension, raw materials are in shortage, prompting countries to continuously develop, study and seek new plastic forming technologies and methods that can save energy and materials.

At present, the large-size thin-walled ring shell parts are mainly manufactured by a method of segmented stamping forming first and then welding into an integral part, i.e., dividing a thin-walled ring shell part into two or more fan-shaped parts for separate forming and assembling the formed parts by welding technology [Development and challenge of forming manufacturing technologies for aerospace large-scale thin-wall axisymmetric curved-surface components. Zhang Hongrui. 2022]. Due to the existence of a lot of weld seams in the thin-walled ring shells manufactured by the current manufacturing technology, many problems of poor surface quality, low dimensional accuracy, microstructural defects which easily occur at the weld seams, and degradation of mechanical properties exist. To avoid the influence of excessive weld seams, it is necessary to form an integral structural ring shell. However, the deformation of sheet metal during forming of a large-size thin-walled ring shell often exceeds the forming limit of the sheet metal, and the integral forming of a large-size thin-walled ring shell cannot be achieved by traditional sheet metal stamping forming methods.

In recent years, researchers conduct studies on integral forming methods such as integral deep drawing forming and integral superplastic forming [Forming method for superplastic forming die of aircraft inlet lip. Zhu Li. 2018. An integral forming die and forming method for the ring lip of aircraft engine. Li Kui. 2019]. Both the integral deep drawing forming and the integral superplastic forming require large-size dies and large forming equipment, which results in high cost and low efficiency. A large-size sheet is very sensitive to thickness deviation in case of plastic deformation and is very easy to produce defects of serious thinning of local wall thickness. Meanwhile, in order to alleviate forming defects, it is necessary to adopt an extensive edge compression method and supplement a large number of process segments, and the resulting formed component needs cutting of blanking regions and process segments, resulting in serious waste of raw materials.

In conclusion, to eliminate the adverse effects of poor surface quality, low dimensional accuracy, microstructural defects and loss of mechanical properties caused by excessive weld seams on the large-size thin-walled ring shell having a weld joint structure, a large-size thin-walled ring shell with an integral structure is urgently needed. However, when a traditional forming method is used to form the large-size thin-walled ring shell having an integral structure, the requirements for die size and equipment capacity are very high, and the defects such as wrinkling and cracking are easily produced, so it is necessary to develop a new integral forming method for a large-size thin-walled ring shell.

SUMMARY

In order to solve the problems of excessive weld seams, degradation of microstructural and mechanical properties, large size of forming dies, high requirements for equipment and low material utilization of the existing forming methods for a large-size thin-walled ring shell, the present invention proposes a new integral forming method for a large-size thin-walled ring shell.

The technical solution of the present invention is as follows:

An integral forming method for a large-size thin-walled ring shell, comprising the following steps:

Step 1: analyzing characteristics of a target part, and determining a forming scheme and the size of a billet Analyzing the characteristics of the target part, and determining the cross-sectional shape and size of a required cylinder billet. It is necessary to analyze the influence of a weld seam when the cylinder billet is bent and formed, and the weld seam is placed in the most favorable position for part forming. For an enclosed cross-sectional ring shell component, i.e., an enclosed cross-sectional ring shell part obtained without cutting or by radial cutting, the weld seam should be placed in a position with small deformation to avoid weld seam failure and improve material forming properties, or placed in a position where the part is less stressed in service to improve the service performance of the part. For an open cross-sectional ring shell component, i.e., an open cross-sectional part obtained by circumferential cutting, it can be considered to butt two open ring shells to form an enclosed ring shell and place the weld seam in the butt joint region on the inner side or the outer side of the ring shell. Then, predicting the generation and distribution of wrinkling defects in each forming step by simulation, and further optimizing the shape, size and forming process parameters of the cylinder billet and each preform according to simulation results. Placing the axial weld seam and the wrinkling defects of the cylinder billet in a process segment, and cutting off the process segment with the weld seam and the wrinkles after forming, so as to obtain an open thin shell component meeting the requirements for shape and size.

Step 2: manufacturing a cylinder billet with a straight axis

According to the analysis results of step 1, determining the material and size of a sheet billet, and manufacturing the sheet billet into the cylinder billet by roll welding. The cross section of the cylinder billet can be circular, oval or racetrack-shaped according to the requirements of the part. In this step, other technologies can also be used to manufacture the required cylinder billet.

Step 3: bending the straight cylinder billet to make both end faces thereof butted and welded into an enclosed ring-shaped prefabricated billet;

Step 4: carrying out local mold-constrained thermal expansion forming of the ring-shaped prefabricated billet Carrying out thermal expansion forming of the ring-shaped prefabricated billet obtained in step 3 in a local constrained expansion die. In the forming process, the expansion forming of local regions not fully formed such as bending wrinkles of the ring-shaped prefabricated billet is achieved under the action of high temperature and high pressure, and the remaining unformed regions do not undergo plastic deformation due to low temperature;

Step 5: carrying out rotational progressive thermal expansion forming of the ring shell;

Rotating the local formed ring-shaped prefabricated billet obtained in step 4 by a certain angle, and continuing local constrained thermal expansion forming according to step 4; and repeating the step of local thermal expansion forming until each region of the ring shell meets design requirements;

Step 6: cutting off the process segment to obtain the target part

According to the characteristics of the target part, obtaining an integral ring shell component without cutting, or obtaining two open cross-sectional ring shell components by circumferential cutting, or obtaining a segmented enclosed cross-sectional ring shell component by radial cutting, or obtaining a segmented open cross-sectional ring shell component by circumferential and radial cutting.

The present invention has the following beneficial effects:

1. In the integral forming method for a large-size thin-walled ring shell of the present invention, a straight cylinder billet with the cross-sectional shape similar to the cross-sectional shape of a target ring shell component is used as a billet, and the cross section is changed little in the subsequent forming process, which effectively avoids risks of large deformation and cracking caused by drastic changes in the cross section.
2. The integral ring shell obtained by the integral forming method for a large-size thin-walled ring shell of the present invention has only one circumferential weld seam and one radial weld seam. If the two weld seams are located in the excisable process segment region, the target part without a weld seam can be obtained after the process segment is cut off. Compared with the traditional methods, multiple weld seams between the thin-walled ring shell parts having a weld joint structure are eliminated, and the service performance of the thin-walled ring shell components is effectively improved.
3. The integral forming method for a large-size thin-walled ring shell of the present invention adopts a local thermal expansion forming method, plastic deformation occurs only in mold-constrained high temperature regions in a single local forming process, and a part with each region meeting the requirements can be obtained after several local thermal expansion forming processes. The required dies and equipment have small size, low cost, high efficiency, simple operation and high forming accuracy.
4. The integral forming method for a large-size thin-walled ring shell of the present invention can obtain two open cross-sectional ring shell components or multiple segmented ring shell components at one time, which can improve the production efficiency and significantly improve the material utilization.

Figure 1:
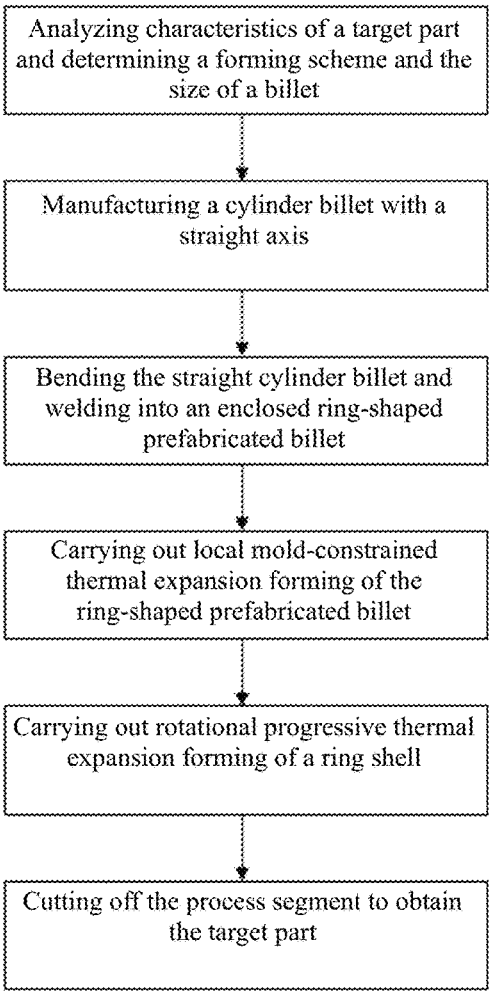
FIG. 1 is a flow chart of an integral forming technology for a large-size thin-walled ring shell of the present invention.

In the figures: 1 original sheet, 2 cylinder billet after roll welding, 3 circular cross section, 4 oval cross section, 5 racetrack-shaped cross section, 6 cylinder billet before bending, 7 cylinder billet after bending, 8 cylinder billet after welding, 9 thermal expansion forming die, 10 upper die of thermal expansion forming die, 11 die heating device, 12 lower die of thermal expansion forming die, 13 air pressure controller, 14 compressed air source, 15 open cross-sectional ring shell component obtained by circumferential cutting, 16 segmented enclosed cross-sectional ring shell component obtained by radial cutting, and 17 segmented open cross-sectional ring shell component obtained by circumferential and radial cutting.

DETAILED DESCRIPTION

Specific embodiments of the present invention are further described below in combination with the drawings and the technical solution.

Embodiment 1

Step 1: analyzing characteristics of a target part, and determining a forming scheme and the size of a billet.

Analyzing the characteristics of the target part, and determining the cross-sectional shape and size of a required cylinder billet. It is necessary to analyze the influence of a weld seam when the cylinder billet is bent and formed, and the weld seam is placed in the most favorable position for part forming. For an enclosed cross-sectional ring shell component, i.e., an enclosed cross-sectional ring shell part obtained without cutting or by radial cutting, the weld seam should be placed in a position with small deformation to avoid weld seam failure and improve material forming properties, or placed in a position where the part is less stressed in service to improve the service performance of the part. For an open cross-sectional ring shell component, i.e., an open cross-sectional part obtained by circumferential cutting, it can be considered to butt two open ring shells to form an enclosed ring shell and place the weld seam in the butt joint region on the inner side or the outer side of the ring shell. Then, predicting the generation and distribution of wrinkling defects in each forming step by simulation, and further optimizing the shape, size and forming process parameters of the cylinder billet and each preform according to simulation results. Placing the axial weld seam and the wrinkling defects of the cylinder billet in a process segment, and cutting off the process segment with the weld seam and the wrinkles after forming, so as to obtain an open thin shell component meeting the requirements for shape and size.

Step 2: manufacturing a cylinder billet with a straight axis. According to the analysis results of step 1, determining the material and size of a sheet billet, and manufacturing the sheet billet into the cylinder billet by roll welding. The cross section of the cylinder billet can be circular, oval or racetrack-shaped according to the requirements of the part. In this step, other technologies can also be used to manufacture the required cylinder billet.

Step 3: bending the straight cylinder billet to make both end faces thereof butted and welded into an enclosed ring-shaped prefabricated billet.

Step 4: carrying out local mold-constrained thermal expansion forming of the ring-shaped prefabricated billet. Carrying out thermal expansion forming of the ring-shaped prefabricated billet obtained in step 3 in a local constrained expansion die. In the forming process, the expansion forming of local regions not fully formed such as bending wrinkles of the ring-shaped prefabricated billet is achieved under the action of high temperature and high pressure, and the remaining unformed regions do not undergo plastic deformation due to low temperature.

Step 5: carrying out rotational progressive thermal expansion forming of the ring shell. Rotating the local formed ring-shaped prefabricated billet obtained in step 4 by a certain angle, and continuing local constrained thermal expansion forming according to step 4. Repeating the step of local thermal expansion forming to achieve progressive thermal expansion forming until each region of the ring shell meets design requirements.

Figure 6:
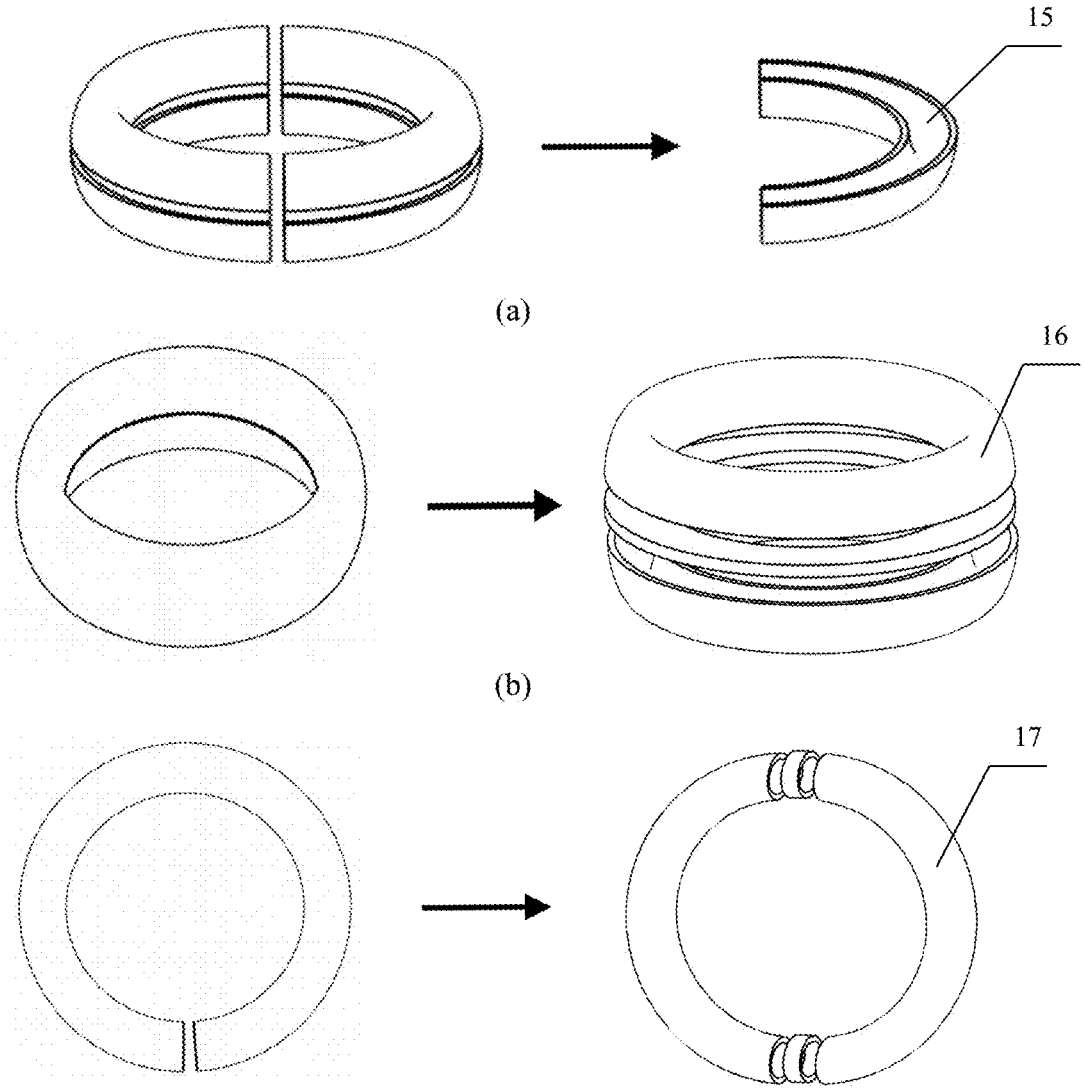
FIG. 6 shows schematic diagrams of cutting of a metal ring of the present invention, wherein (a) is a structural schematic diagram of an open cross-sectional ring shell component obtained by circumferential cutting, (b) is a structural schematic diagram of a segmented enclosed cross-sectional ring shell component obtained by radial cutting, and (c) is a structural schematic diagram of a segmented open cross-sectional ring shell component obtained by circumferential and radial cutting.

Step 6: cutting off the process segment to obtain the target part. According to the characteristics of the target part, obtaining an integral ring shell component without cutting; or as shown in FIG. 6*a*, obtaining open cross-sectional ring shell components by cutting along a circumferential weld seam; or as shown in FIG. 6*b*, obtaining a segmented enclosed cross-sectional ring shell component by cutting along a radial weld seam, or as shown in FIG. 6*c*, obtaining a segmented open cross-sectional ring shell component by circumferential and radial cutting.

Advantages of embodiment 1: (1) with the method of bending a sheet into a cylinder, the cross-sectional shape and size of the straight cylinder billet can be specially designed to effectively reduce the deformation degree of the material when forming thin-walled ring shell parts and reduce risks of wrinkling and cracking; (2) the weld seam obtained by roll welding of the straight cylinder billet can be cut off as the process segment, which can significantly reduce the length of the weld seam and improve the service performance and stability of thin-walled ring shell parts; (3) a progressive thermal expansion forming method for a ring is adopted, an integral enclosed cylinder billet is used as an original billet and loaded from inside, the enclosed cylinder billet can balance the load as long as a local constrained die is added, so integral dies and large equipment are not required in the whole forming process; and (4) the integral forming method is adopted, cutting is carried out after forming, and according to the requirements of the part, two open cross-sectional ring shell components or multiple segmented ring shell components can be obtained at one time, so the forming efficiency is high and the cost is low.

Embodiment 2

Figure 2:
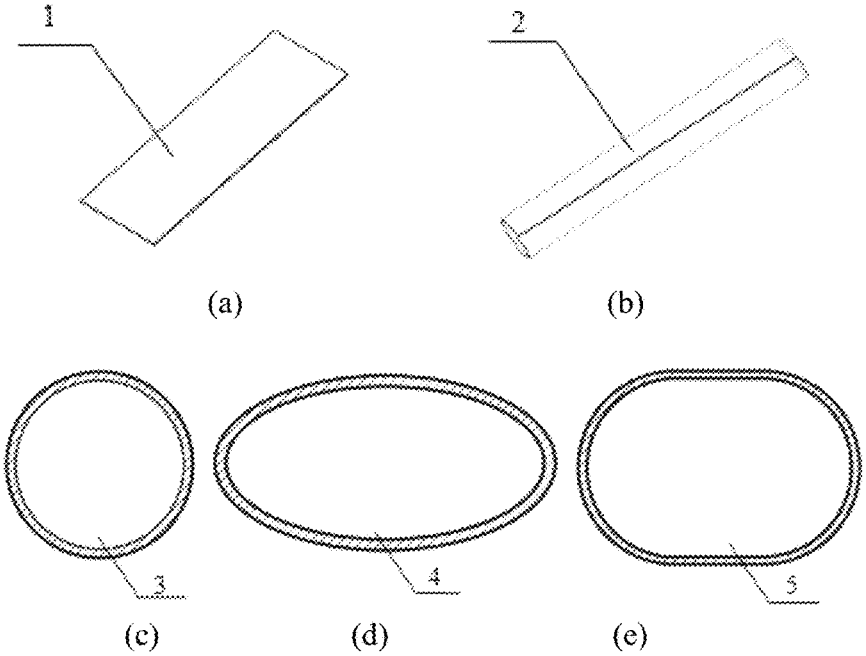
FIG. 2 shows schematic diagrams of roll welding of sheet metal into a straight cylinder billet and cross-sectional shapes of typical cylinder billets of the present invention, wherein (a) is a structural schematic diagram of an original sheet, (b) is a structural schematic diagram of a cylinder billet after roll welding, (c) is a structural schematic diagram of a circular cross section of a cylinder billet, (d) is a structural schematic diagram of an oval cross section of a cylinder billet, and (e) is a structural schematic diagram of an racetrack-shaped cross section of a cylinder billet.

Combined with FIG. 2*b*, in step 2, the cross-sectional shape of the straight cylinder billet can be determined according to the requirements of the part, which can be circular, oval or racetrack-shaped. Other steps are the same as those in embodiment 1.

Advantages of embodiment 2: round corners are formed by roll bending forming, parts with different cross-sectional shapes can be formed according to the requirements of the parts, the forming method is simple and is easy to implement, and the forming efficiency is high.

Embodiment 3

Combined with FIG. 2*a*, in step 2 and step 3, cylinders and rings obtained in step 3 and step 5 can be welded by laser welding. Other steps are the same as those in embodiment 1. Advantages of embodiment 3: (1) the laser welding has the advantages of small laser spot diameter, high accuracy and small heat input, so heat-affected zones, weld-induced deformation and residual stress are smaller than those of arc welding, thus being suitable for high-precision welding occasions. (2) The obtained thin-walled ring shell parts have high weld seam forming quality and better adapt to extreme service environments such as aerospace and petrochemical industry. (3) The laser beam can be transmitted through optical fiber, with high flexibility, facilitating the integration of finished products with automated equipment.

Embodiment 4

Figure 4:
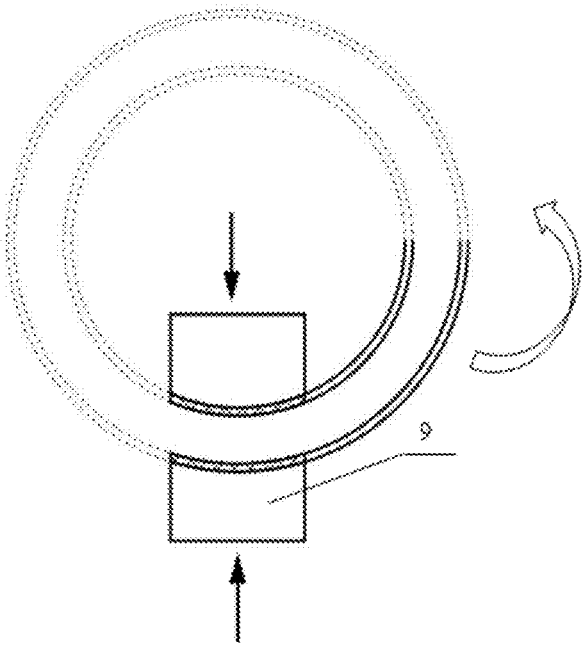
FIG. 4 is a schematic diagram of progressive thermal expansion forming of a metal ring of the present invention (solid lines show a formed region, and dotted lines show an unformed region).

Combined with FIG. 4, in steps 4 and 5, an appropriate thermal forming temperature is selected for thermal expansion forming according to different materials of the thin-walled ring shell such as titanium alloy and aluminum alloy. Other steps are the same as those in embodiment 1.

Advantages of embodiment 4: the common materials of thin-walled ring shell parts such as aluminum alloy and titanium alloy are difficult to accurately form at room temperature, so the forming method of thermal forming can reduce the deformation resistance of the metal, increase the elongation and improve the forming accuracy.

Embodiment 5

Figure 5:
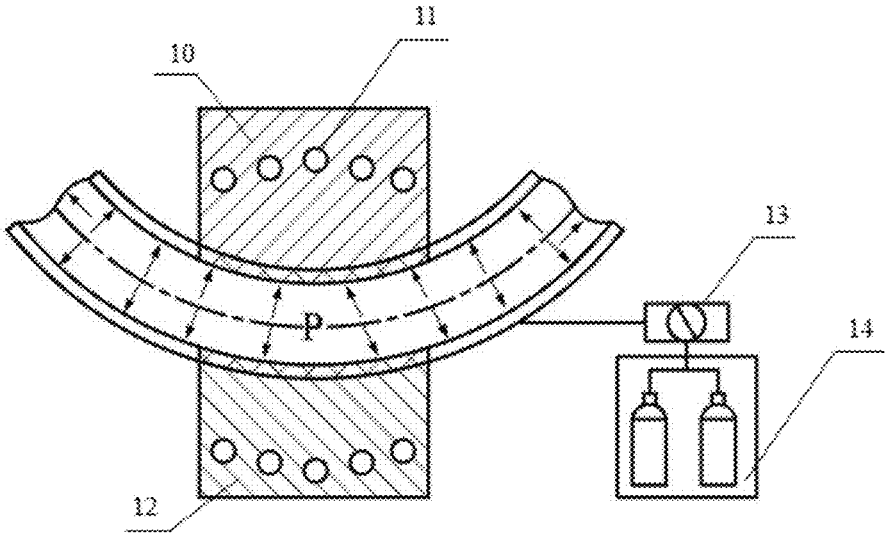
FIG. 5 is a schematic diagram of a progressive thermal expansion forming device of a metal ring of the present invention.

Combined with FIG. 4 and FIG. 5, in steps 4 and 5, the die is heated to 300-550° C. by induction heating equipment or an electric heating rod, and a high-pressure air pump introduces 0.1-15 MPa of high-pressure air medium into a part through a medium channel to carry out thermal expansion forming. Other steps are the same as those in embodiment 1.

Advantages of embodiment 5: (1) the use of gas for expansion can apply uniform pressure throughout the part, and the gas pressure changes little with a cavity shape, so that the internal pressure control is more accurate. (2) The required high-pressure air source can be pressurized by absorbing air through a high-pressure pump station and thus is easy to obtain, and the cost is low. (3) The temperature and the pressure are maintained at high temperature and high pressure for a period of time, which is conducive to control of microstructural properties of the formed part.

Embodiment 6

Figure 3:
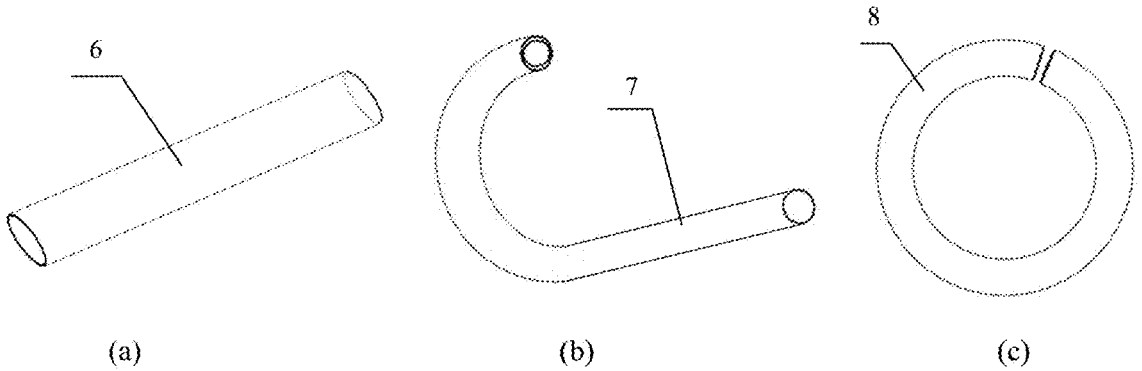
FIG. 3 shows schematic diagrams of bending forming of a straight cylinder billet into a ring-shaped prefabricated billet of the present invention, wherein (a) is a structural schematic diagram of a cylinder billet before bending, (b) is a structural schematic diagram of a cylinder billet after bending, and (c) is a structural schematic diagram of a cylinder billet after welding.

Combined with FIG. 2*a* and FIG. 3, in steps 1, 2 and 3, for an enclosed cross-sectional ring shell component, the side surface of the cylinder billet is stressed greatly when the cylinder billet is bent. Therefore, the weld seam during roll welding can be reserved at the top or bottom of the cylinder billet to reduce the force on the weld seam, so as to avoid weld seam failure and improve the forming properties. Other steps are the same as those in embodiment 1.

Advantages of embodiment 6: the position of the weld seam during forming is designed in advance according to the requirements of the part to reduce the force on the weld seam, so as to avoid weld seam failure, reduce the forming difficulty and improve the forming properties.

The invention claimed is:

1. An integral forming method for a large-size thin-walled ring shell, comprising the following steps:

step 1: analyzing characteristics of a target part, and determining a forming scheme and the size of a cylinder billet;

firstly, analyzing characteristics of the target part, and determining the cross-sectional shape and size of the cylinder billet;

secondly, analyzing the influence of a weld seam when bending and forming the cylinder billet, and determining a position of the weld seam;

finally, predicting the generation and distribution of wrinkling defects in the forming step by simulation, and further optimizing the shape, size and forming process parameters of the cylinder billet and each preform according to simulation results; and placing the axial weld seam and the wrinkling defects of the cylinder billet in a process segment, and cutting off the process segment with the weld seam and the wrinkles after forming, so as to obtain a thin-walled ring shell meeting the requirements for shape and size;

step 2: manufacturing a straight cylinder billet;

according to the analysis results of step 1, determining the material and size of a sheet billet, and manufacturing the sheet billet into the straight cylinder billet by roll welding;

step 3: bending the straight cylinder billet to make both end faces thereof butted and welded into an enclosed ring-shaped prefabricated billet;

step 4: carrying out local mold-constrained thermal expansion forming of the enclosed ring-shaped prefabricated billet;

carrying out thermal expansion forming of the enclosed ring-shaped prefabricated billet obtained in step 3 in a local constrained expansion die; in the forming process, the expansion forming of local regions not fully formed of the enclosed ring-shaped prefabricated billet is achieved under the action of high temperature and high pressure, and the remaining unformed regions do not undergo plastic deformation due to low temperature;

step 5: carrying out rotational progressive thermal expansion forming of the ring shell;

rotating a local formed ring-shaped prefabricated billet obtained in step 4 by a certain angle, and continuing local constrained thermal expansion forming according to step 4; and repeating the step of local thermal expansion forming until each region of the ring shell meets design requirements;

step 6: cutting off the process segment to obtain the target part;

according to the characteristics of the target part, obtaining an integral ring shell component without cutting, or obtaining two open cross-sectional ring shell components by circumferential cutting, or obtaining a segmented enclosed cross-sectional ring shell component by radial cutting, or obtaining a segmented open cross-sectional ring shell component by circumferential and radial cutting.

2. The integral forming method for a large-size thin-walled ring shell according to claim 1, wherein in step 1, the position of the weld seam is divided into two cases: first, for an enclosed cross-sectional ring shell component, wherein the enclosed cross-sectional ring shell component is an enclosed cross-sectional ring shell part obtained without cutting or by radial cutting, the weld seam should be placed in a position with small deformation or placed in a position where the part is less stressed in service; second, for an open cross-sectional ring shell component, wherein the open cross-sectional ring shell component is an open cross-sectional part obtained by circumferential cutting, it can be considered to butt two open ring shells to form an enclosed ring shell and place the weld seam in the butt joint region on the inner side or the outer side of the ring shell according to the requirements of the target part.

3. The integral forming method for a large-size thin-walled ring shell according to claim 1, wherein in step 2, the cross section of the straight cylinder billet is circular, oval or racetrack-shaped.

* * * * *